US006143137A

United States Patent [19]

Gerstenkorn et al.

[11] Patent Number: 6,143,137

[45] Date of Patent: Nov. 7, 2000

[54] COOLING POCKET FOR A ROTARY DRUM COOLER HAVING A FLEXIBLE VENT PIPE ASSEMBLY

[75] Inventors: Ralph Gerstenkorn; Robert William Biederstadt, both of Bellingham; Jack Richard Highlander, Jr., Ferndale; John William Daly, Bellingham, all of Wash.

[73] Assignee: Atlantic Richfield Company, Chicago, Ill.

[21] Appl. No.: 09/152,093

[22] Filed: Sep. 11, 1998

[51] Int. Cl.[7] ..... C10B 39/00; C10B 39/10; C10B 29/04; F28D 11/08; F28D 11/02

[52] U.S. Cl. ..... 202/227; 202/268; 165/88; 165/90; 201/39

[58] Field of Search ..... 202/227, 268, 202/229–230; 165/88, 90, 134.1; 201/39; 34/138, 134, 331; 432/80, 85

[56] References Cited

U.S. PATENT DOCUMENTS

| | | | |
|---|---|---|---|
| 2,899,176 | 8/1959 | Francis et al. . | |
| 3,917,516 | 11/1975 | Waldmann et al. . | |
| 4,044,824 | 8/1977 | Eskeli | 165/88 |
| 4,557,804 | 12/1985 | Baumgartner et al. . | |
| 4,597,773 | 7/1986 | Quintana et al. | 48/197 R |
| 4,667,731 | 5/1987 | Baumgartner et al. . | |
| 4,747,913 | 5/1988 | Gerstenkorn et al. . | |
| 5,333,840 | 8/1994 | Sköld et al. | 266/47 |
| 5,622,604 | 4/1997 | Gerstenkorn et al. | 202/227 |
| 5,927,970 | 7/1999 | Pate et al. | 432/115 |

FOREIGN PATENT DOCUMENTS

| | | |
|---|---|---|
| 0149798A2 | 7/1985 | European Pat. Off. . |
| 4326678A1 | 2/1995 | Germany . |
| 2195424A | 4/1988 | United Kingdom . |

OTHER PUBLICATIONS

PCT Notification of Transmittal of the International Search Report or the Declaration for International Application No. PCT/GB 99/02921.

*Primary Examiner*—Marian C. Knobe
*Assistant Examiner*—Alexa A. Doroshenk
*Attorney, Agent, or Firm*—Robert A. Yesukevich

[57] ABSTRACT

A rotary drum cooler for cooling particulate material (e.g. coke particles) having at least one cooling pocket which, in turn, includes a flexible vent pipe assembly which can slide in relation to the shell of the cooler. By making the vent pipe slidable, it can move in response to the expansion and contraction of the pocket within the shell. The vent pipe assembly is comprised of (a) a tube which is connected to the pocket and which slidably extends through an aperture in the shell and (b) a flexible means for sealingly connecting the outer end of the tube to the shell.

7 Claims, 4 Drawing Sheets

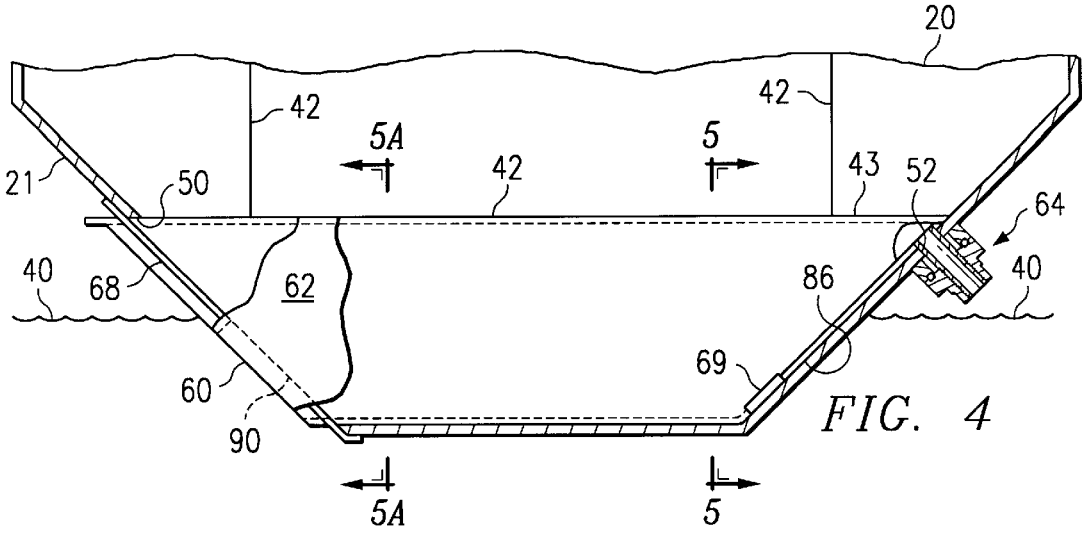
FIG. 4
FIG. 5
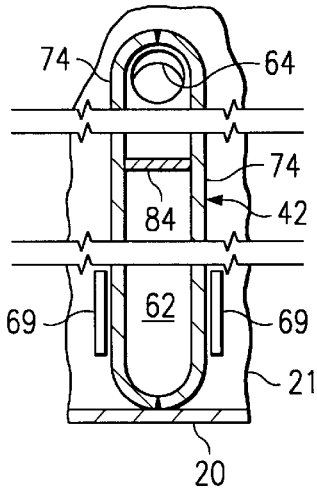
FIG. 5A
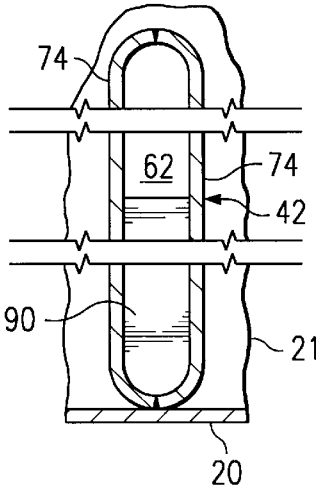
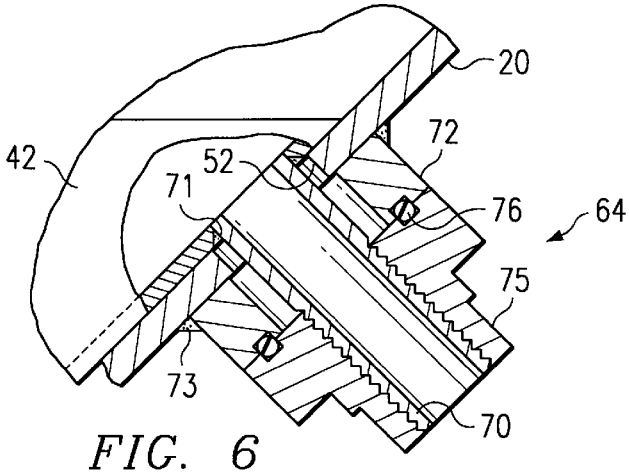
FIG. 6

COOLING POCKET FOR A ROTARY DRUM COOLER HAVING A FLEXIBLE VENT PIPE ASSEMBLY

DESCRIPTION

1. Technical Field

The present invention relates to a rotary drum cooler for cooling particulate or granular material and in one aspect relates to a rotary drum cooler for cooling particulate material such as petroleum coke wherein the shell of the cooler has at least one improved cooling pocket which, in turn, includes a vent tube which is free to expand and contract with respect to the shell in response to changes in temperatures during cooling operations to thereby prevent damage (e.g. cracking) to the pocket-to-shell weldments due to thermal and fatigue stresses.

2. Background

In certain commercial processes, particulate or granular material is treated at high-temperatures in a retort or the like to produce a desired end product. For example, petroleum coke is typically treated by heating crushed "green coke" in a calciner (e.g. rotary kiln or oven) to remove substantially all of the residual hydrocarbons from the coke thereby producing "calcined coke" (i.e. substantially pure carbon). Since the temperatures in these calciners reach extremely, high-temperatures (e.g. 2000° F. or greater), the particles of the calcined coke are usually white-hot and glowing as they exit from the calciner. The calcined coke must then be cooled before it undergoes further handling.

As is known in the art, rotary drum coolers (often referred to as "coke cooling rotors", these terms used interchangeably herein) are commonly used for this purpose. Basically, a rotary drum cooler or coke cooling rotor is comprised of a shell (also sometimes referred to as the "drum" or "rotor"; also used interchangeably herein) which rotates within a housing which, in turn, has a water-bath in the bottom thereof. The hot coke enters one end of the drum or shell and the rotation of the shell causes the coke to move towards the other end where lifters pick up and carry the coke out of the drum.

While known coke cooling rotors or rotary drum coolers may differ in construction, almost all such coolers now include some form of "cooling pockets" which are spaced along the length of the drum. These pockets are formed or fitted within slots in the shell so that the external surfaces of each pocket will be in direct contact with the hot coke within the shell during a cooling operation. As the shell rotates, each pocket fills with water as the pocket passes through the water bath on the bottom of the housing. Heat from the hot coke is transferred to the cooler water in each pocket as that pocket is exposed to the coke. Due to this heat exchange, the water in a pocket heats up rapidly and quickly loses its cooling efficiency. Accordingly, the pockets are designed to empty and re-fill with cool water during each revolution of the shell. For examples of coke coolers which include cooling pockets, see U.S. Pat. Nos. 2,899,176 to Francis et al.; 3,917,516 to Waldmann et al.; 4,557,804 to Baumgartner et al.; 4,667,731 to Baumgartner et al.; and 4,747,913 to Gerstenkorn et al.

It is now well established that the exposed surfaces of the cooling pockets are subjected to severe wear and possible failure during the cooling operation. This is due to the abrasive nature of the granulated coke and the extreme temperatures within the shell. To compensate for the possibility of early failure of one or more of the cooling pockets, several drum coolers of this type now use removable cooling pockets which can be individually replaced when the need arises. One such coke cooler is that disclosed in U.S. Pat. No. 5,622,604 to Gerstenkorn et al. As disclosed therein, the cooling pockets are individual units which are positioned and temporarily secured (e.g. fillet welded) within respective slots along the drum.

Each substantially trapezoidal-shaped pocket has an opening at one end through which the pocket fills with cooling water as the drum rotates through the water bath in the housing. The pocket has a vent pipe or tube (sometimes also called "drain pipe") at its other end which vents the pocket during filling. The open end of the pocket is secured in its slot by a plate which is welded to both the pocket and the wall of the shell. The vent pipe at the other end of the pocket passes through an opening in the wall of the shell and is rigidly secured thereto by spot welding a flange or the like around the outer end of the vent pipe and to the surface of the shell.

Unfortunately, by rigidly securing the ends and/or vent pipe of each pocket directly to the wall of the shell, as is done in know, prior art coolers of this type, the sides and/or the vent pipe is not free to expand and/or contract as the pocket undergoes substantial thermal expansion and contraction during a cooling operation thereby resulting in thermally-induced stress fractures which are unacceptable. Any crack will allow the water from the pockets to leak into hot coke within the shell which, in turn, causes the cooling operation to be halted for repairs. As will be appreciated by those skilled in the art, this results in considerable down time and high maintenance costs.

SUMMARY OF THE INVENTION

The present invention provides a rotary drum cooler for cooling particulate material (e.g. coke particles) having at least one cooling pocket which, in turn, has a flexible vent pipe which can slide in relation to the shell of the cooler. By making the vent pipe slidable, it can move in response to the expansion and contraction experienced by the pocket within the shell due to changes in temperature during a cooling operation. This significantly reduces the failures of pocket-to-shell weldments caused by the thermal and fatigue stresses.

More specifically, the present invention provides a rotary drum cooler which is comprised of a housing adapted to have a bath of cooling liquid (e.g. water) in the lower portion thereof. An elongated shell is rotatably mounted in the housing and has an inlet at one end for receiving the particulate material to be cooled. The shell has an outlet at its other end through which the particulate material is removed after it has passed through the shell.

At least one cooling pocket (preferably a plurality) is positioned within openings or slots along the length of the shell whereby the sides of each cooling pocket will be in direct contact with the hot, particulate material as it moves through the shell. Each pocket is open at one end whereby the pocket can be filled with cooling liquid as each pocket in the shell is rotated through the cooling bath. A flexible, vent pipe assembly is provided on the other end of each pocket through which the cooling liquid can vent from the pocket after the cooling liquid has been heat-exchanged with the hot particulate material within the shell during the rotation of the shell. This vent pipe assembly also allow air to escape from the pocket as the pocket is being filled with cooling liquid. A baffle can be provided within the pocket near the open end thereof to retard the flow of cooling liquid back out the open end during rotation.

The flexible vent pipe assembly is comprised of a tube which is slidably positioned through an aperture in the shell. The tube has an inner end which is affixed to and is in fluid communication with the other end of the pocket. The vent pipe assembly includes a flexible means for sealingly connecting the outer end of the tube to the shell so that the tube can slide within the aperture in the shell as the pocket expands/contracts within the shell due to changes in temperature during a cooling operation.

The flexible means is comprised of a flange affixed to the shell around the aperture and a retainer which is threaded or welded onto the outer end of the tube with a seal (e.g. an O-ring) positioned between the flange and the retainer. In one embodiment, the seal is comprised of a bellows which is connected between the flange and the retainer while in another embodiment, the seal is comprised of a flexible sleeve (e.g. rubber sleeve) which is connected between the flange and the retainer.

BRIEF DESCRIPTION OF THE DRAWINGS

The actual construction, operation, and apparent advantages of the present invention will be better understood by referring to the drawings which are not necessarily to scale and in which like numerals identify like parts and in which:

FIG. 4 is a sectional view taken along line 4—4 of FIG. 1;

FIG. 5 is a sectional view taken along line 5—5 of FIG. 4;

FIG. 5A is a sectional view taken along line 5A—5A of FIG. 4;

FIG. 6 is an enlarged, sectional view of the flexible vent pipe assembly of the cooling pocket of FIG. 5;

DETAILED DESCRIPTION OF THE INVENTION

Figure 1:
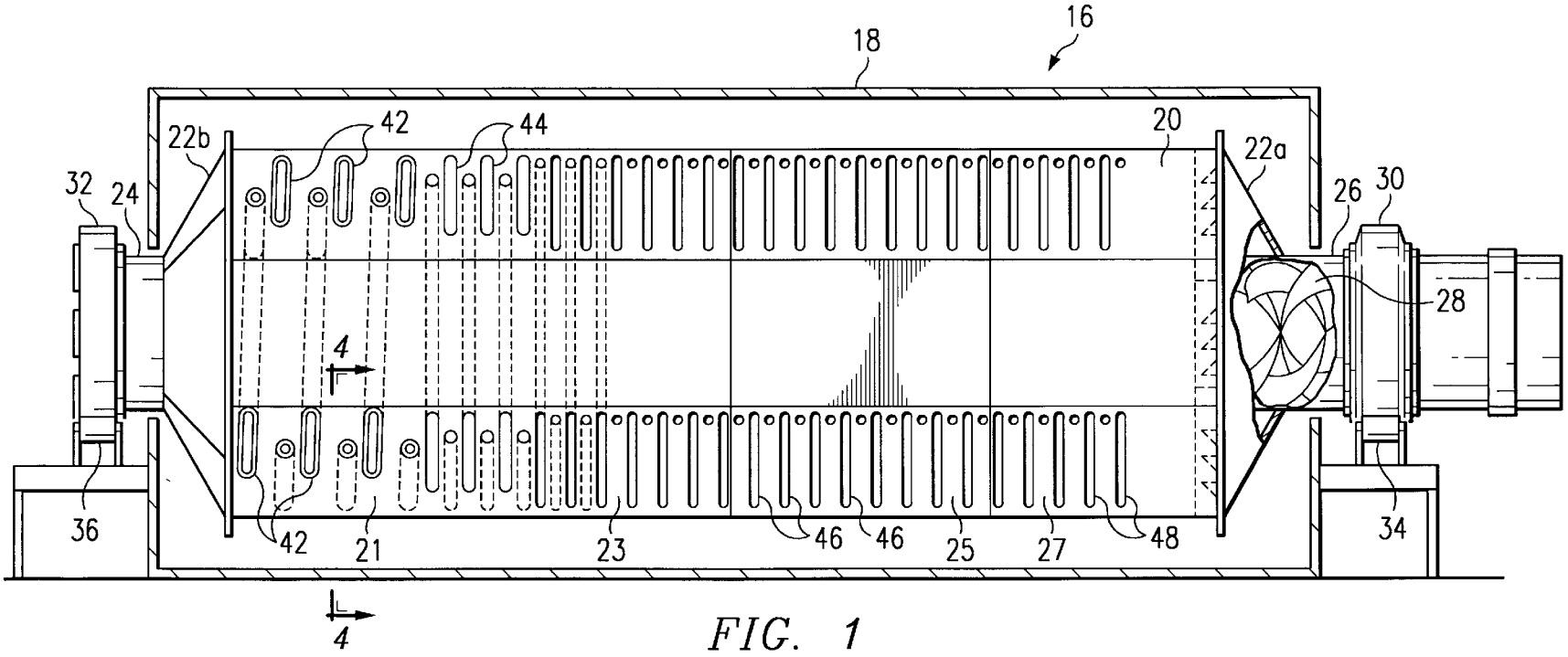
FIG. 1 is an elevational view, partly in section, of a typical drum cooler in accordance with the present invention.
Figure 2:
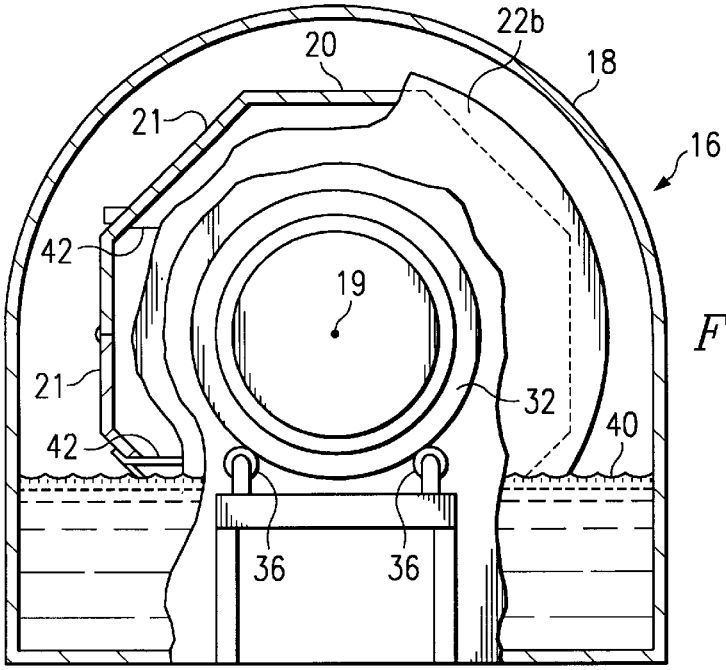
FIG. 2 is an end view, partly in section of the drum cooler of FIG. 1.

Referring now to FIGS. 1 and 2, there is illustrated a rotary drum cooler (e.g. coke cooling rotor) generally designated by the numeral 16. Rotary cooler 16 is comprised of an elongated drum or shell 20 which is rotatably mounted within a housing 18. Shell 20 is preferably octagonal in cross-section and is closed at either end by frusto-conical end caps 22*a*, 22*b*. An inlet duct 24 is connected to end cap 22*b* through which hot granulated or crushed material (e.g.. coke particles, not shown) is passed from an inlet chute, also not shown, into drum 20. An outlet duct 26 having auger flights 28 secured therein passes through the other end cap 22*a* and provides an outlet for the "cooled" particles, as will be understood in the art. The shell 20 is mounted for rotation about a central longitudinal axis 19 (FIG. 2)on tires 30, 32 or the like which, in turn, are supported on respective roller assemblies 34, 36, again as will be understood in the art.

Housing 18 has a bath of cooling liquid (e.g. water) 40 in the bottom or lower portion thereof. Housing may also include a suitable nozzle array (not shown) for spraying cooling fluid (e.g. water) onto the surface of shell 20 as is typical in coolers of this type. Shell 20 is partially immersed in the cooling bath 40 so that at least some of the cooling liquid (e.g. water) in bath 40 will be scooped-up by each of the cooling pockets 42, 44, 46, and 48 on shell 20 as the drum rotates through the bath; this being explained in more detail below.

The cooling pockets 42, 44, 46, and 48, as well as the components of the shell 20 which support these pockets, are all of similar construction except for the relative size of the respective pockets. That is, the pockets 44, 46, and 48 are of somewhat narrower and deeper configuration in varying degrees than are pockets 42 to thereby maximize the heat transfer surfaces on the respective pockets. Otherwise, the construction of all of the plates which make up shell 20 and which support the cooling pockets is basically the same as will now be described.

Figure 3:
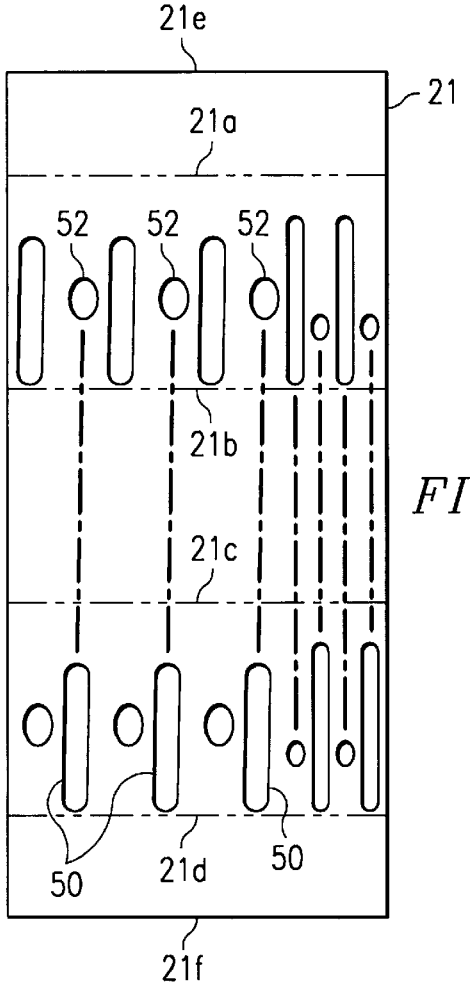
FIG. 3 is an enlarged, plan view of a section of the wall of the drum cooler of FIG. 1.

Referring now to FIGS. 1, 2, and 3, shell 20 is made up of opposed pairs of metal plates 21, 23, 25, and 27 (e.g. carbon steel and/or stainless-clad steel plates) which are bent along respective fold lines (e.g. 21*a*–21*d* in FIG. 3) so that when the plates are welded together along their opposed parallel edges (e.g. 21*e*, 21*f* in FIG. 3), they form the desired octagonal cross-section of shell 20.

Prior to the bending and welding of the respective plates, specially-designed openings are formed in each plate for receiving the respective cooling pockets. As shown in FIG. 3, an elongated slot 50 for a particular pocket is formed in one plate while an aligned, smaller aperture 52 for the same pocket is formed in the opposed plate so that when a pocket (to be described below) is inserted through its slot 50, the vent pipe of that pocket will pass through its respective, aligned aperture 52 in the opposed plate, i.e. on the other side of the shell.

Each of the cooling pockets 42, 44, 46, and 48 are of the basically the same construction and vary primarily only in size. Referring now to FIGS. 4 and 5, a typical pocket 42 is made up of a pair of trapezoidal-shaped steel plates 74 which are bent and welded together to form the oval-shaped tubular space 62 (FIG. 5), this being the space which will hold the cooling water when in operation. Supports or webs 84 or the like may be positioned and welded between the plates to add rigidity to the pocket 42 where needed. The pocket is open at one end (e.g. opening 60) to receive a cooling liquid (e.g. water) from bath 40 of the cooling liquid as the shell 20 rotates within housing 18 and is closed at the other end 86, which, in turn, has an opening adapted to receive the vent pipe. When pocket 42 is in its operable position within shell 20, the vent pipe will extend through its respective aperture 52 in the wall of shell 20.

The vent pipe for each pocket is sized so that the air in each pocket is allowed to escape while the pocket is filling. The vent pipe is located at the upper corner of the pocket so that it serves as a high point vent. This allows the cooling water to readily flow into space 62 within the pocket since the vent pipe also provides a vent for the otherwise trapped air and water vapor in the "empty" pocket.

In operation, shell 20 is constructed with slots 50 and vent apertures 52 properly aligned in opposed plates. The cooling pockets 42, 44, 46, and 48 are then inserted through their respective slots 50 until the vent pipe on each pocket extends through its respective aligned aperture 52 on the other side of shell 20. As the vent pipe of each pocket passes through its aperture 52, the front edge of the pocket moves in between a respective pair of locator plates 69, which, in turn, are welded to the inside of shell 20. Plates 69 helps to align the pocket and aids in maintaining the pocket in its operational position within shell 20 during cooling operations. In some instances, plates 69 may be replaced by a plug weld or the like.

After a pocket is in place within shell 20, the open end 60 is removably secured to one wall of the shell by means of doubler plate 68 (FIG. 4) which is fillet welded or otherwise secured to both the shell and the pocket while the vent pipe is temporarily secured to the opposed wall. The basic construction and operation of rotary shell cooler 16 as described to this point is known and is clearly disclosed and fully explained in U.S. Pat. No. 5,622,604 to Gerstenkorn et al., issued Apr. 22, 1997 which is incorporated herein in its entirety by reference.

In rotary shell coolers such as that disclosed in U.S. Pat. No. 5,622,604, the vent pipe is firmly affixed directly to the wall of the shell by a flange which is welded to both the vent pipe and to the wall of the shell. By firmly affixing the vent pipe directly to the wall of the shell, the vent pipe is not free to expand and/or contract in response to the temperature changes normally experienced during the cooling operation. Since the vent tube can not expand and contract (i.e. lengthen and shorten) as the pocket expands and contracts, thermally induced stress cracks and fractures are likely to occur in the pocket to shell weldment. If and when this happens, water can leak into the shell and, as will be understood in the art, this usually results in considerable downtime and substantial increases in the maintenance costs of the cooling operation.

Figure 7:
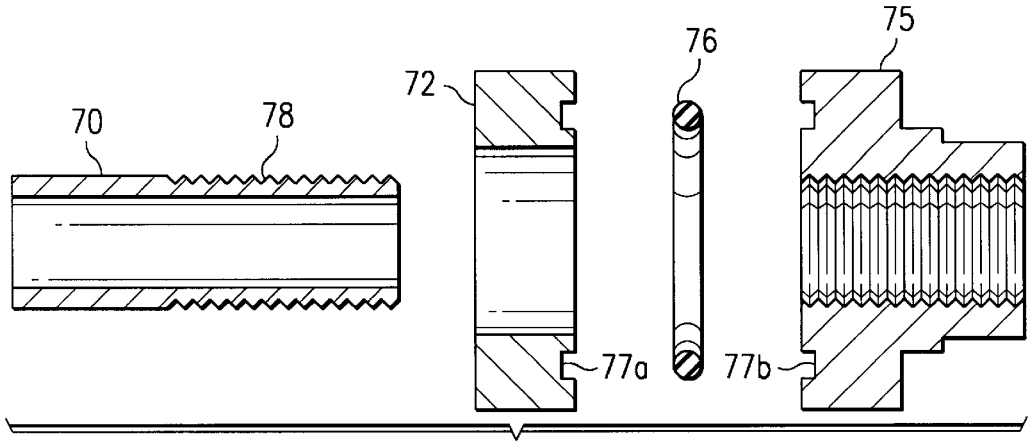
FIG. 7 is an exploded, sectional view of the components of the flexible vent pipe assembly of FIG. 6.

In accordance with the present invention, the vent pipe assembly 64 for each cooling pocket is comprised of a flexible, vent pipe assembly 64 which allows the cooling pocket to freely expand and contract in response to temperature changes encountered during the cooling operation. Referring now to FIGS. 4, 6 and 7, flexible vent pipe assembly 64 is comprised of a conduit or tube 70 having its inner end firmly affixed and secured within an opening in the upper corner of a cooling pocket 42 by welds 71 or the like (FIG. 6) to thereby provide a vent outlet for the pocket. The outer end of tube 70 slidably extends through aperture 52 in shell 20 and through a smooth-bored, circular flange 72, which, in turn, is secured directly to the wall of shell 20 around aperture 52 by welds 73 or the like. The outer length 78 of conduit 70 is threaded to receive internally-threaded, retainer or collar 75. An O-ring seal 76 or the like is positioned in a groove formed by recesses 77*a* in flange 72 and 77*b* in retainer 75 (FIG. 7) to prevent leakage of water into shell 20 between the flange 72 and collar 75 when the vent pipe assembly 64 is in its assembled position on shell 20.

To assemble vent pipe assembly 64, the inner end of tube 70 is positioned within the opening in the pocket 42 and is secured therein by welds 71 or the like. It can be seen that tube 70 provides fluid communication between the space 62 and the exterior of the pocket. As pocket 42 is fully inserted through its respective slot 50 in shell 20, the threaded end of tube 70 will pass through its respective aperture 52 on the other side of shell 20 and will extend through both the aperture 52 and flange 72 which, in turn, has been secured to the shell around opening 52. Retainer 75 is then threaded onto tube 70 (with O-ring 76 in place) to snugly secure the vent pipe assembly 64 to shell 20.

However, since the diameters of both aperture 52 and the bore of flange 72 are larger than that of tube 70, the tube is now free to move in relation thereto. Further, since there is no rigid connection between (a) the flange 72 which is welded to the shell 20 and (b) the retainer 75 which is threaded on conduit 70, the conduit 70 can now freely expand and contract at the interface between the flange and the retainer. As will be appreciated, this relieves any thermally-induced stresses in the conduit 70 and substantially reduces the chance of weld failures in the pocket to shell weldments.

Figure 8:
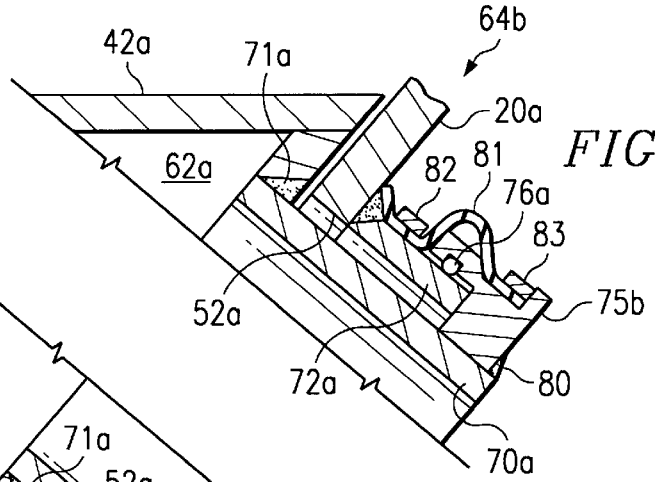
FIGS. 8, 9, and 10 are all sectional views of further embodiments of the flexible vent pipe assembly for a cooling pocket in accordance with the present invention.
Figure 9:
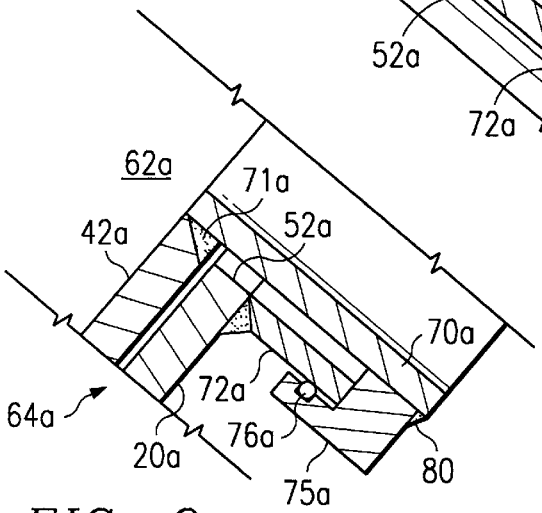
Figure 10:
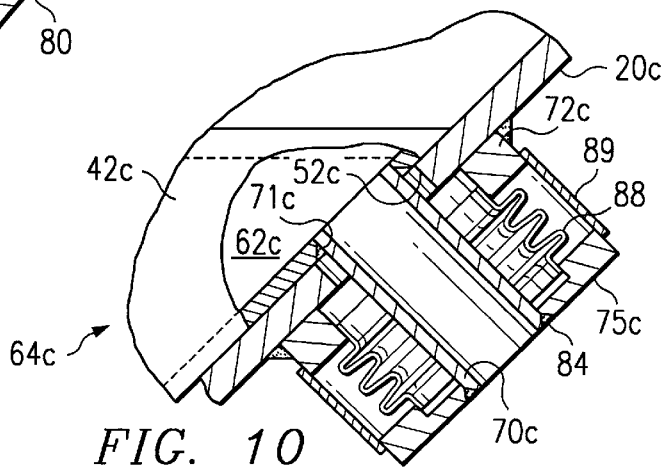

FIGS. 8, 9, and 10, all disclose further embodiments of the flexible, vent pipe assembly of the present invention. Referring first to FIG. 9, flexible, vent pipe assembly 64*a* is comprised of a conduit 70*a* which has its inner end secured within an opening in cooling pocket 42*a* by welds 71*a* or the like. The outer end of conduit 70*a* extends through aperture 52*a* in the wall of shell 20*a* and through flange 72*a* which, in turn, is affixed to the wall of shell 20*a* by welding or the like.

A retainer 75*a* is fixed to the outer end of conduit 70*a* by welds 80 or other means (e.g. threads, not shown) and is slidably positioned over retainer 70*a* with an O-ring seal 76*a* or the like therebetween. It can be seen that since conduit 70*a* is free to slide within both the aperture 52*a* and the flange 75*a* and since retainer 75*a* is free to slide relative to flange 72*a,* the conduit can readily expand and contract in response to changes in temperature without inducing any substantial stresses in the vent pipe.

The embodiment 64*b* of FIG. 8 is basically the same as that shown in FIG. 9 except a flexible sealing sleeve 81 (e.g. rubber) is secured at one end to flange 72*a* by a band 82 or the like and at its other end to retainer 75*b* by band 83 or the like to further guard against leakage of water between the flange and the retainer from the pocket into the shell.

Referring now to FIG. 10, flexible vent pipe assembly 64*c* is comprised of a conduit 70*c* which has one end secured within an opening in cooling pocket 42*c* by welds 71*c* or the like. The other end of conduit 70*c* extends through aperture 52*c* in shell 20*c* and through flange 72*c* which, in turn, is secured to the wall of shell 20*c* by welds or the like. A retainer 75*c* is secured to the outer end of conduit 70*c* by penetration welds 84 or the like or by some other means (e.g. threads, not shown). An expandable seal (e.g. bellows 88) is connected to the inner surfaces of flange 72*c* and retainer 75*c* so that conduit 70*c* is free to expand and contract through aperture 52*c* in shell 20*c* in response to changes in temperature of the cooling pocket within shell 20. A cover sleeve 89, which protects bellows 88, is positioned between flange 72*c* and retainer 75*c* but is affixed at only one end (shown welded to flange 72*c* in FIG. 10) so that sleeve 89 is free to move as vent pipe 70*c* expands or contracts with the pocket during the cooling operation.

By eliminating the rigid attachment of the vent pipe directly to the wall of the shell, the flexible, vent pipe assembly of the present invention allows the vent pipe to slide with respect to the shell as its respective cooling pocket undergoes expansion and contraction (i.e. filling and emptying of the pocket with water) during the rotation of the cooler shell. This relieves any thermally-induced stresses within the cooling pocket which otherwise might cause cracks in the pocket-to shell weldments and the problems normally related thereto and reduces the probability one or more welds may fail during the cooling operations; thereby substantially reducing downtime normally encountered in coolers of this type and the maintenance costs involved therewith.

Also, in the present invention, one or more baffles 90 (only one shown in FIGS. 4 and 5A) may be affixed to the bottom, inside of each pocket 42–48 as viewed in FIGS. 4 and 5A) at open end 60 to retard the flow of cooling liquid back through the filling opening 60 after a pocket has been filled and is rotated from the water bath through the upper portion of housing 18. Further, additional vent pipes (not shown) may be provided for some of the pockets to allow quicker and more complete venting of the pockets, if needed.

What is claimed is:

1. A rotary drum cooler for cooling particulate material, said cooler comprising:

a housing adapted to have a bath of cooling liquid therein;

an elongated shell rotatably mounted in said housing, said shell having an inlet at one end for receiving said particulate material and an outlet at the other end through which said particulate material is removed after it has passed through said shell, said shell having openings spaced along one side thereof and apertures in the opposite side of the shell wherein each of said openings is aligned with a respective aperture;

a cooling pocket positioned into each of said openings whereby said pocket is in contact said particulate material as said material passes through said shell, each of said pockets being open at a first end through which said pocket can be filled with said cooling liquid as said shell is rotated through said bath of cooling liquid in said housing;

a vent pipe assembly at a second end of said pocket, said vent pipe assembly comprising:

a tube, said tube slidably extending through a respective aperture in said shell and having an inner end and an outer end, said inner end of said tube being affixed to and in fluid communication with said second end of said pocket; and flexible means for sealingly connecting said outer end of said tube to said shell for allowing said tube to slide within said aperture in said shell in response to expansion/contraction of said pocket within said shell.

2. The rotary drum cooler of claim 1 wherein said flexible means comprises:

a flange affixed to said shell around said aperture a retainer affixed to said outer end of said tube and being slidable with respect to said flange; and a seal between said flange and said retainer to prevent the flow of liquid therebetween.

3. The rotary drum cooler of claim 2 wherein said retainer is affixed to said outer end of said tube by threads.

4. The rotary drum cooler of claim 2 wherein said retainer is affixed to said outer end of said tube by welding.

5. The rotary drum cooler of claim 2 wherein said seal comprises a bellows connected at one end to said flange and at its other end to said retainer.

6. The rotary drum cooler of claim 2 wherein said seal comprises a flexible sleeve connected at one end to said flange and at its other end to said retainer.

7. The rotary drum cooler of claim 1 wherein said cooling pocket includes a baffle affixed within said pocket near said open end to retard the flow of cooling liquid from said pocket through said open end after said pocket has been filled and as said shell is being rotated through the upper portion of said housing.

* * * * *